US008808205B2

(12) United States Patent
Freeman

(10) Patent No.: US 8,808,205 B2
(45) Date of Patent: Aug. 19, 2014

(54) METHOD AND DEVICE FOR MECHANICAL CHEST COMPRESSION WITH OPTICAL ALIGNMENT

(75) Inventor: Gary Freeman, Chelmsford, MA (US)

(73) Assignee: ZOLL Medical Corporation, Chelmsford, MA (US)

( * ) Notice: Subject to any disclaimer, the term of this patent is extended or adjusted under 35 U.S.C. 154(b) by 125 days.

(21) Appl. No.: 13/605,203

(22) Filed: Sep. 6, 2012

(65) Prior Publication Data

US 2014/0066822 A1 Mar. 6, 2014

(51) Int. Cl.
*A61H 31/00* (2006.01)
*A61H 31/02* (2006.01)

(52) U.S. Cl.
USPC ..... 601/41; 601/44

(58) Field of Classification Search
USPC ..... 601/41, 44; 600/587
See application file for complete search history.

(56) References Cited

U.S. PATENT DOCUMENTS 4,082,090 A * 4/1978 Harrigan ..... 601/97
8,281,788 B2 * 10/2012 Thompson et al. ..... 128/205.13
2005/0010274 A1 1/2005 Dupelle et al.
2008/0097257 A1 4/2008 Stromsnes
2010/0004571 A1 * 1/2010 Nilsson et al. ..... 601/41
2010/0185127 A1 7/2010 Nilsson et al.
2011/0092864 A1 * 4/2011 Woerlee et al. ..... 601/41
2011/0201979 A1 * 8/2011 Voss et al. ..... 601/41

FOREIGN PATENT DOCUMENTS

WO WO2012038855 3/2012

* cited by examiner

*Primary Examiner* — Justine Yu
*Assistant Examiner* — Kathrynn Reilly
(74) *Attorney, Agent, or Firm* — K. David Crockett, Esq.; Paul J. Backofen, Esq.; Crockett & Crockett, PC

(57) ABSTRACT

Optical alignment for piston driven chest compression devices optimizes the application of chest compressions to a fixed location on a subject's chest and provides information regarding the depth and frequency of chest compressions. The targeting system records and may display some telemetry corresponding to any movement or "walking" away from the selected compression site as well as the depth and frequency of compressions. The targeting system is interconnected to the compression device controller and the targeting system provides warnings to operators if the compression components contact the subject outside a preset warning limit away from the selected compression site. The targeting system may also halt the compression device if the site of contact between the compression components and the subject is located outside a preset absolute limit.

15 Claims, 3 Drawing Sheets

METHOD AND DEVICE FOR MECHANICAL CHEST COMPRESSION WITH OPTICAL ALIGNMENT

FIELD OF THE INVENTIONS

The inventions described below relate to the field of emergency medical devices and methods and more specifically to methods and device to optimize the resuscitation of cardiac arrest subjects.

BACKGROUND OF THE INVENTIONS

According to the American Heart Association nearly 383,000 out-of-hospital sudden cardiac arrests occur annually in the United States. These subjects may be saved by the timely application of life saving measures such as Cardiopulmonary resuscitation (CPR).

CPR is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., Decay In Quality Of Chest Compressions Over Time, 26 Ann. Emerg. Med. 300 (September 1995). Thus, CPR is not often successful at sustaining or reviving the subject. Nevertheless, if chest compressions could be adequately maintained, then cardiac arrest victims could be sustained for extended periods of time. Occasional reports of extended chest compression efforts (45 to 90 minutes) have been reported, with the victims eventually being saved by coronary bypass surgery. See Tovar, et al., Successful Myocardial Revascularization and Neurologic Recovery, 22 Texas Heart J. 271 (1995).

In efforts to provide better blood flow and increase the effectiveness of bystander resuscitation efforts, various mechanical devices have been proposed for performing automated chest compressions. There are currently two types of automated chest compression devices. One type uses a belt placed around the subject's chest to effect chest compressions. The AutoPulse® chest compression is one such device, and is described in patents such as Mollenauer, et al., Resuscitation Device having a Motor Driven Belt to Constrict/Compress the Chest, U.S. Pat. No. 6,142,962 (Nov. 7, 2000). The other type uses a piston which repeatedly compresses the chest. Piston based chest compression systems include the LUCAS® chest compression device (illustrated in Sebelius, et al., Rigid Support Structure on Two Legs for CPR, U.S. Pat. No. 7,569,021 (Aug. 4, 2009)) and the THUMPER® chest compression device (illustrated in Barkolow, Cardiopulmonary Resuscitator Massager Pad, U.S. Pat. No. 4,570,615 (Feb. 18, 1986). These chest compression systems include a piston and a motor for repeatedly driving the piston downwardly on the chest, and lifting the piston from the chest to allow the chest to expand under its own natural resistance.

As mechanical compressions are performed by piston based chest compression systems, the compression components may shift position relative to the subject. When an automated chest compression system does not apply chest compressions to the appropriate location on the subject's chest the effectiveness of the automated chest compressions are diminished. The repeated extension and retraction of the piston often results in the piston moving or "walking" up the subject's chest toward the neck or moving down toward the subject's abdomen.

SUMMARY

The devices and methods described below provide for an optical alignment or targeting system in a chest compression device for confirming initial placement of the device on the subject's chest and monitoring the movements of the chest compression device relative to the selected compression site on the subject's chest. The targeting system records and may display some telemetry corresponding to any movement or "walking" away from the selected compression site as well as the depth and frequency of compressions. The targeting system is interconnected to the compression device controller and the targeting system provides warnings or other status indications to operators if the compression components contact the subject outside a preset warning limit away from the selected compression site. The targeting system may also halt the compression device if the site of contact between the compression components and the subject is located outside a preset absolute limit.

Alternatively, the compression device may be programmed to operate with a reduced compression stroke depth if the targeting system detects contact between the compression components and the subject outside one or more preset operation limits from the ideal compression site. The control system may also provide adjustable compression depth based on the physical dimensions of the subject's chest.

The distance between the selected compression site and the point of contact between the compression components and the subject that is needed for initiating warnings, halting operation or reducing compression stroke depth may be preset or adjusted based on the dimensions of the subject.

The targeting system includes one or more optical sensors for viewing and recording the movements of the compression device components, the relative positioning of the compression components on the chest of the subject.

DETAILED DESCRIPTION OF THE INVENTIONS

Figure 1:
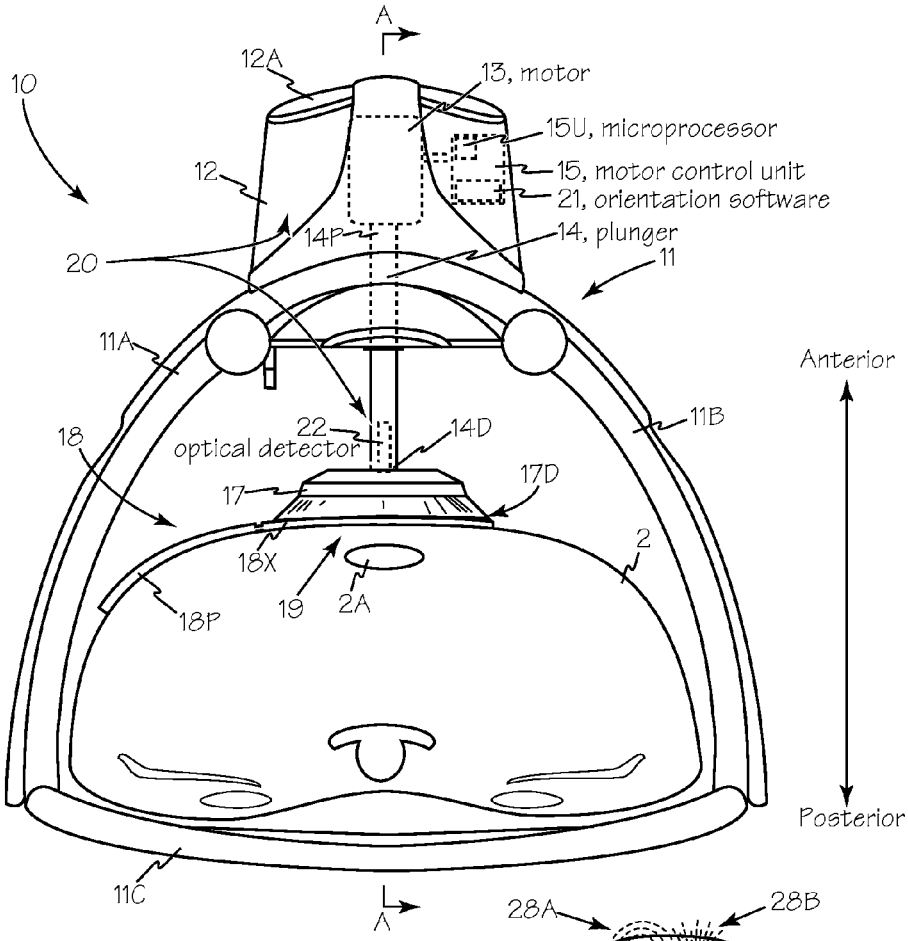
FIG. 1 is a front view of a piston driven chest compression device with optical detectors, a targeting system and a cross section of a subject's chest showing landmark skeletal structures and a compression and electrode pad secured to the subject.
Figure 2:
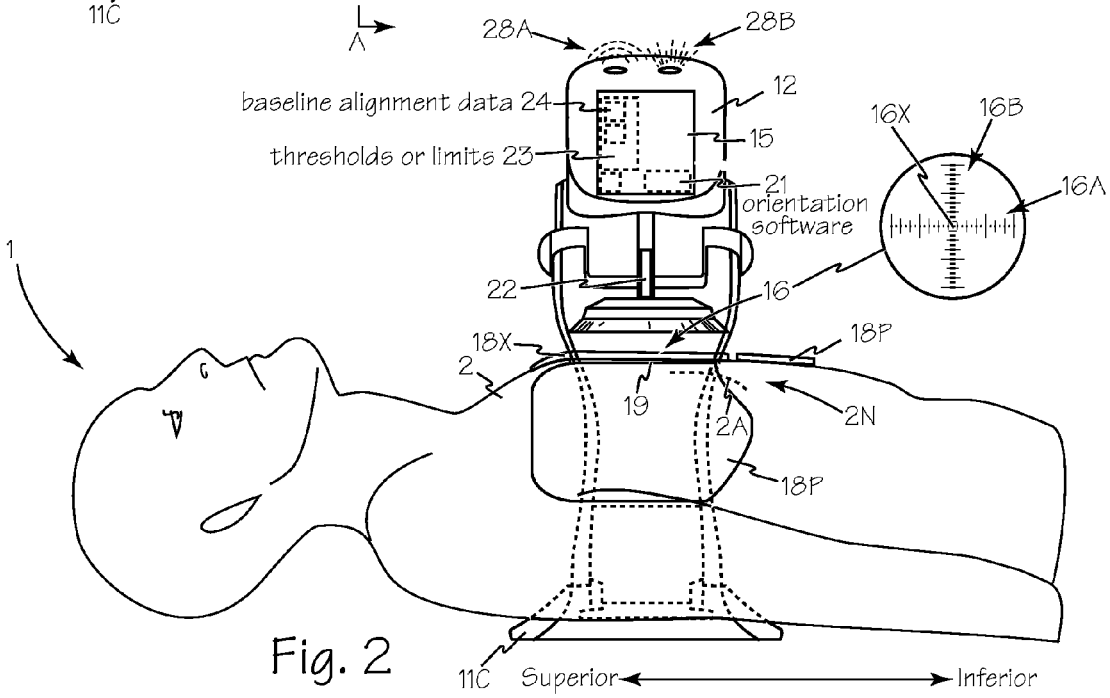
FIG. 2 is a cross section of the chest compression device of FIG. 1 taken along A-A with a compression and electrode pad secured to the subject.

FIGS. 1 and 2 show a piston operated chest compression device with optical detectors, a targeting system and a cross section of a subject's chest showing landmark skeletal structures and a compression and electrode pad secured to the subject. Mechanical chest compression device 10 is oriented to apply compressions to the chest 2 of subject 1. Chest compression device 10 includes support structure 11 which supports and orients chest compression unit 12 apposing sternum 2A. Support structure 11 may include two or more legs such as legs 11A and 11B connected to a backplate such as backplate 11C. Alternatively, support structure 11 may be a single leg or post and a cantilever mount supporting chest compression unit 12. Chest compression unit 12 includes any suitable drive means such as motor 13 which may be a reversible electromotor, a linear, pneumatic or hydraulic actuator or the like. Plunger 14 has a distal end 14D and a proximal end 14P, and proximal end 14P of the plunger is operably coupled to motor 13. Distal end or plunger tip 14D extends from and withdraws into the housing upon operation of motor 13. A motor control unit or controller 15 is operably connected to motor 13 and includes a microprocessor 15U to control the operation of the motor and the plunger and one or more or firmware routines or instruction sets to enable the controller to initially orient the piston or compression components with the subject and to track the operation if the compression components. The end of the plunger, distal end 14D, may be used to compress the subject's chest. Alternatively, a suitable compression component may be secured to the distal end of the plunger to distribute the compression force to a larger area of the subject's chest. Compression component 1617, if used, is secured to the distal end of the plunger to make contact with the subject's chest and distribute the compression force.

The chest compression device includes a targeting system that operates to ensure that the plunger is properly positioned initially and during operation of the device. The desired location for application of compression force is in the center of the chest in a superior position relative to sternal notch 2N as illustrated in FIG. 2. Electrode assembly 18 is removably attached to the subject and includes defibrillation pads 18P, bridge 18X and indicia, such as target 16 with the target center point 16X corresponding to force application location 19. 1819 Targeting system 20 includes one or more landmarks secured to the subject's chest such as target 16, orientation software 21 installed in controller 15 and one or more sensors such as optical detector 22 which is secured within plunger 14 and extends through compression component 17. Optical detector 22 is connected to controller 15 for detecting the orientation of plunger 14 and compression component 17 relative to force application location 19 and for detecting any changes of the point of contact of the plunger or compression component from the desired force application location.

The initial extension of plunger 14 and orientation of plunger tip 14D or compression component 17 in contact with compression target 16 may be used by targeting system 20 to determine the subject's sternal height, anterior-posterior height, which can then be correlated to a desired sternal displacement (big people need more compression). Currently, sternal compression of at least 2 inches (for adult subjects) or twenty percent of sternal height is recommended by the American Heart Association. Either of these sternal displacement goals may be met by using targeting system 20 to determining the sternal height and adjusting the piston stroke length accordingly. Additionally, from the initial extension of the plunger, an approximation may be made as to the size of the subject, and this information may be used to adjust other thresholds of the targeting system. Some of the system thresholds or limits 23 are based on the variation or distance between the current compression site, which is the point of contact between the plunger tip and the subject's chest on the current compression stroke, and force application location 19. Targeting system 20 includes a warning threshold or warning limit 23A which is set to provide a visual or audible status indication such as audible indication 28A or visual indication 28B, to the device operator if plunger tip 14D, or compression component 17, contacts the subject's chest more than X distance away from force application location 19. If plunger tip 14D contacts the subject's chest less than X distance away from force application location 19 no warnings are issued and the system may provide a status indication such as a green light or other indication of normal operation and orientation. The targeting system may also include an operation threshold or operational limit 23B which is set to change the depth of chest compressions if plunger tip 14D, or compression component 17, contacts the subject's chest more than Y distance away from force application location 19. Operational limit 23B may also operate to change the depth of compression as a function of distance Y. The targeting system also includes an absolute threshold or absolute limit 23C which is set to terminate chest compressions if plunger tip 14D, or compression component 17, contacts the subject's chest more than Z distance away from force application location 19. Triggering operational limit 23B and absolute limit 23C may also result in generation of a warning to the device operator along with one or more status indicators of the nature or the fault.

In use, electrode assembly 18 is removably secured to the subject's chest with compression target 16 secured to mark the selected compression location at force application location 19. The mechanical chest compression device 10 is oriented around the subject's thorax with compression component 17 apposing compression target 16 which marks force application location 19 on the subject's chest. Plunger 14 is extended to confirm proper siting of plunger tip 14D or compression component 17 on the subject and relative to compression target 16. Upon confirmation of proper alignment and orientation by targeting system 20, the targeting system captures baseline alignment data 24 that includes baseline image 25. Controller 15 is instructed, through any suitable interface such as interface 12A, to perform cyclic compressions and decompressions for CPR. Targeting system 20 continues to collect and process operation data 26 and operating images such as compression image 27 as plunger 14 cyclically compresses the subject's thorax. Compression images such as image 27 are compared to baseline image 25 by controller 15 and targeting software 21. Variation between compression images and the baseline image are compared to variation limits to provide confirmation of proper operation and orientation if appropriate, or to generate an alarm, change the depth of compression or terminate compressions if the variation exceeds the pre-selected limit.

Figure 3:
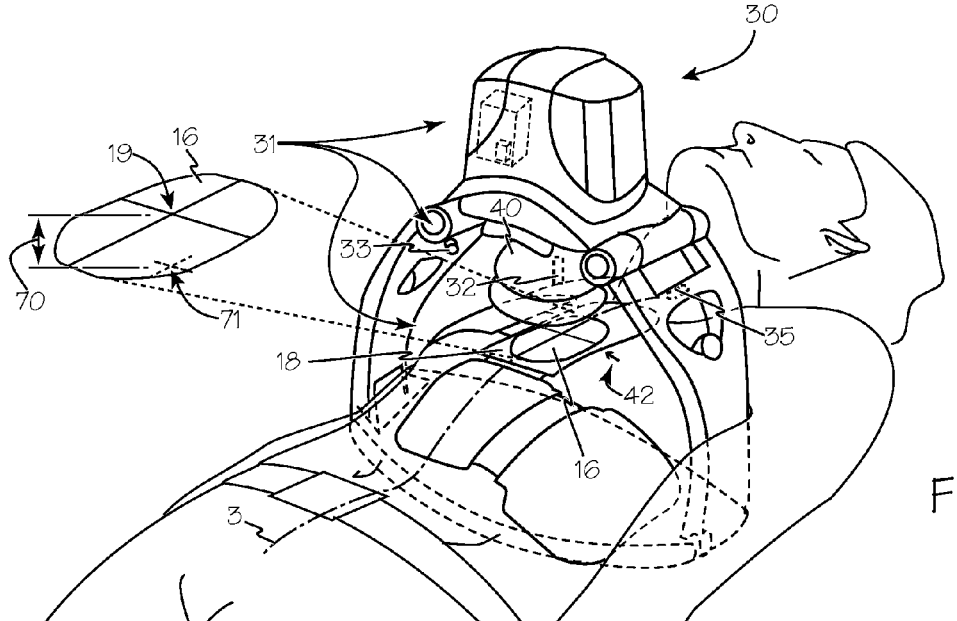
FIG. 3 is a perspective view of a piston driven chest compression device with optical detectors secured to a subject.
Figure 4:
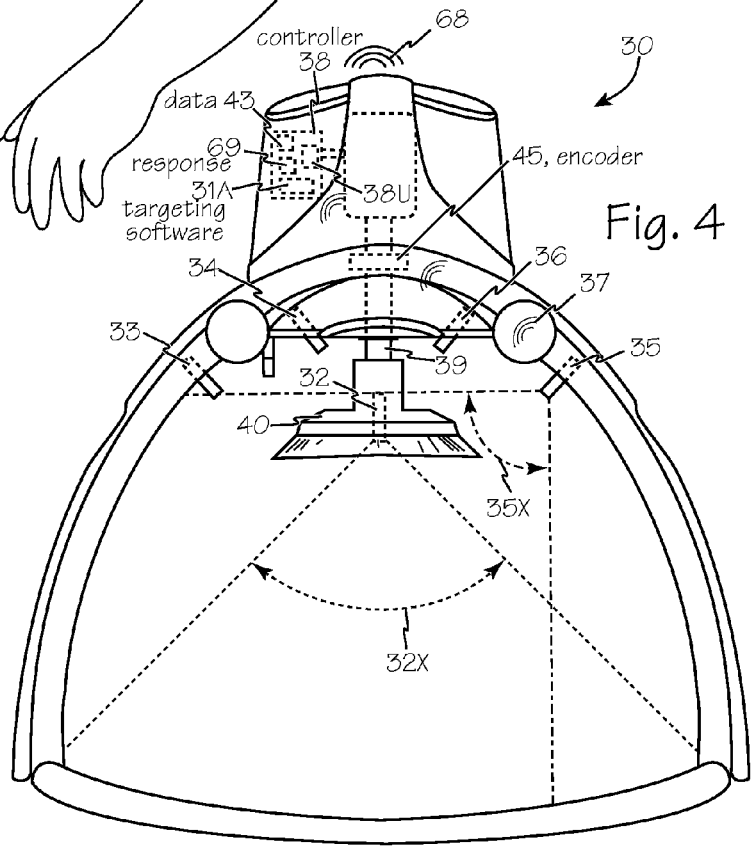
FIG. 4 is a side view of a piston driven chest compression device with optical detectors.

Mechanical chest compression device 30 of FIGS. 3 and 4 includes targeting system 31 that includes two or more targeting or optical sensors such as sensors 32, 33, 34, 35 and 36. Sensors 32, 33, 34, 35 and 36 may be any suitable sensor or combination of sensors such as optical position sensors, CCD sensors, image sensors or photoelectric sensors. Data 37 from the targeting sensors may be communicated to controller 38 and targeting software 31A using any suitable wired or wireless connection. Each optical sensor has a field of view such as field of view 32X for optical sensor 32, or field of view 35X for optical sensor 35. Optical sensors secured to support structure 11 are oriented to include plunger 39, compression component 40 and at least a portion of chest 2 of the subject in their field of view. Targeting system 31 may track the relative positions of elements within its field of view such as compression component 40 and one or more landmarks on the subject's chest such as anatomical landmark 4142. Landmark 42 may be a natural blemish or a temporary mark applied by a rescuer. The relative positions of the elements within the field of view are used by the targeting system to determine any undesired motion of compression component 40 away from force application location 19. Targeting system 31 may determine the depth and frequency of compressions using data 43 derived from the presence and motion of plunger 39 and compression component 40 44 in the field of view, or from an encoder such as encoder 45 coupled to plunger 39.

Figure 5:
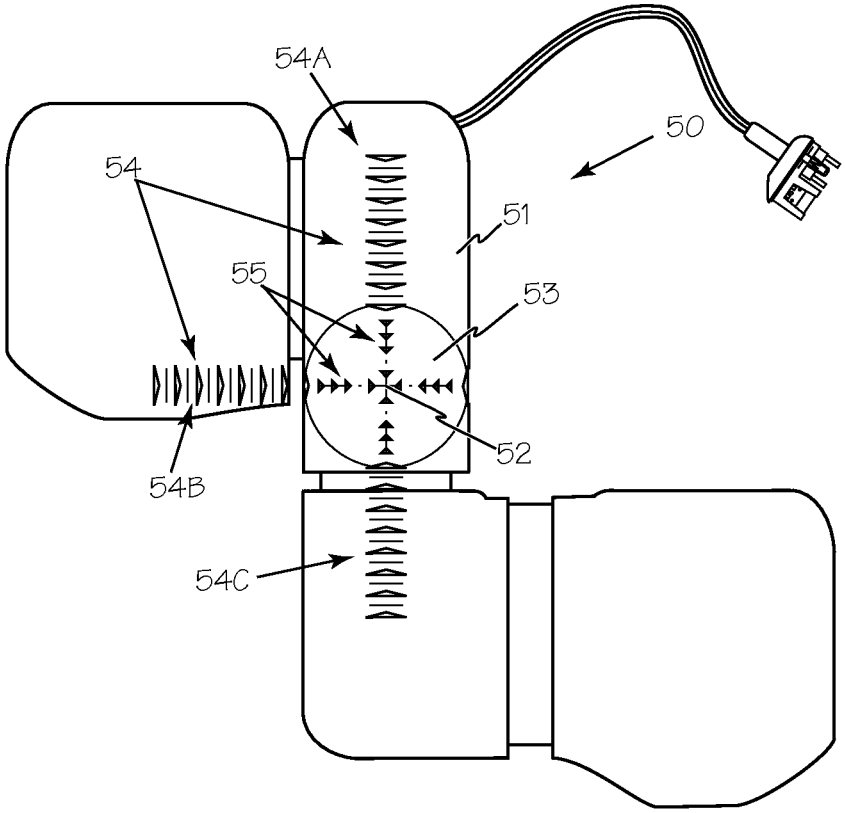
FIG. 5 is a top view of a chest compression and electrode pad.

The indicia to be detected by targeting systems 20 or 31 may be disposed on a removable sticker or pad or an electrode assembly such as electrode assembly 18. Electrode assembly 50 may also include compression pad 51 as illustrated in FIG. 5. Electrode assembly 50 is removably secured to a subject with compression point 52 corresponding to desired force application location 19 above the subject's sternal notch. Pad 51 has a target 53 and may include one or more indicia or scales 54 to enable targeting system 20 to identify and track movement of compression component 17 away from the desired force application location, location 19. Different indicia may be applied to a single subject, target or pad to provide data indicative of rotation, lateral movement and superior-inferior movement and the direction from the indicia to the desired force application location or the target's center point. For example, indicia 55 may be different from scales 54, or they may be oriented differently as illustrated by scales 54A, 54B and 54C. Compression pads such as compression pad 51 may also include electrodes for ECG, defibrillation or other medical accessories.

The indicia, the targets and deviation scales on a compression pad or applied directly to the subject may adopt any suitable configuration. Target 16 of FIGS. 1 and 2 includes first indicia 16A which is oriented parallel to the superior-inferior axis of the patient on the subject's midline 3. Midline 3 is an inherent element of a human body and is a line equidistant from bilateral features of subject's body. Second indicia 16B is oriented perpendicular to midline 3. The differences between first indicia 16A and second indicia 16B permits the targeting system to identify and distinguish movement in any direction from desired force application location 19 which corresponds to target center point 16X. The differences in the indicia may also enable identification of rotation of plunger 14 that may occur during cyclic chest compression.

Figure 6:
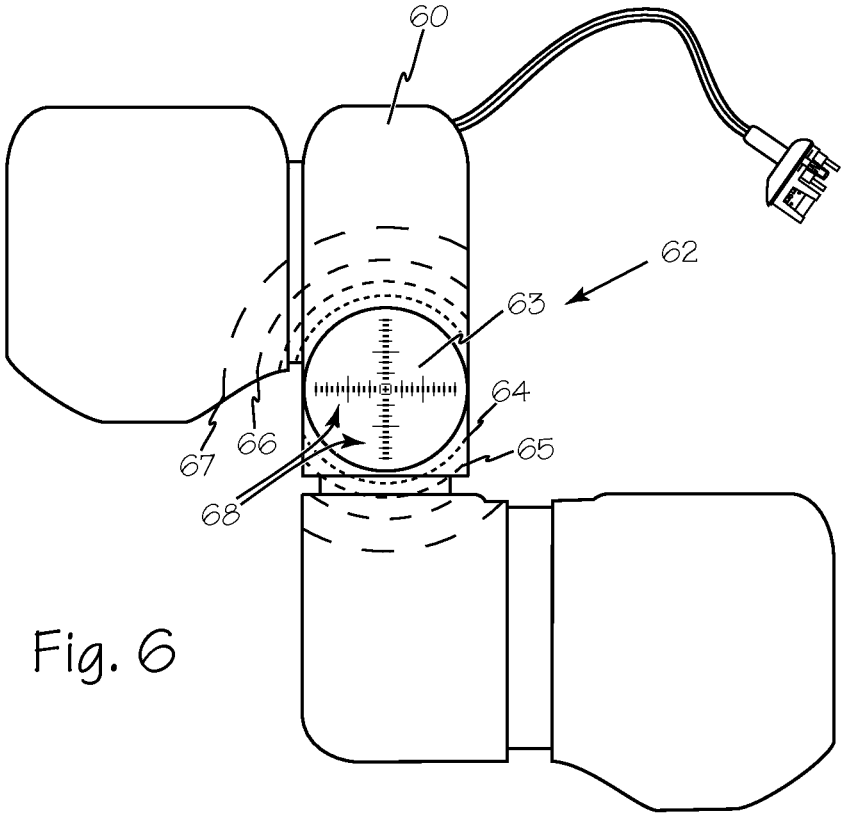
FIG. 6 is a top view of an alternate chest compression and electrode pad.

In FIG. 6, indicia 62 on compression pad 60 includes a generally circular target 63 with one or more concentric indicia such as first border 64, second border 65, third border 66 and fourth or outer border 67. Target 63 may also include one or more scales 68 for use with an optical sensor embedded in the compression component such as video sensor 32 in FIGS. 3 and 4. Target indicia or scales such as concentric borders 64, 65, 66 and 67 of FIG. 6 may be used by targeting software 31A to generate one or more responses 69 such as a warning, termination of compressions or modification of compression depth as discussed above. Using indicia 62 for example, a warning threshold or warning limit may be set to provide a warning to the device operator if the plunger tip or the compression component contacts the subject's chest more than X distance away from the preselected force application location as discussed above. First border 64 may be selected as the warning limit. An operation threshold or operational limit as discussed above which is set to change the depth of chest compressions if the plunger tip or the compression component contacts the subject's chest more than Y distance away from the force application location may be set to correspond to second border 65 or third border 66. The absolute threshold or absolute limit as discussed which terminate chest compressions if the plunger tip or the compression component contacts the subject's chest more than Z distance away from the preselected force application location may be set to correspond to outer indicia 67.

In use, mechanical compression device 30 of FIGS. 3 and 4 includes optical sensor 35 for providing tracking and operation data 37 to controller 38 and targeting software 31A. Microprocessor 38U processes data 37 to determine the depth of compressions, frequency of compressions and deviation of compression component 40 from the selected force application location. Field of view 35X includes compression component 40 as it contacts chest 2 directly or as it contacts electrode and compression pad 18. Comparison and analysis of compression images and a baseline image from sensor 35 is used to determine distance error 70 which is the distance between the point of contact 71 of the compression component 40 on the subject, and the selected force application location 19 identified by a landmark or target such as target 16. Plunger 39 is extended to confirm proper siting of compression component 40 on the subject and relative to compression target 16. Upon confirmation of proper alignment and orientation by targeting system 31, the targeting system captures baseline alignment data as discussed above. Controller 38 is instructed, through any suitable interface, to perform cyclic compressions and decompressions for CPR. Targeting system 31 continues to collect and process operation data and operating images as plunger 39 cyclically compresses the subject's thorax. The compression images are compared to the baseline image by controller 38 and targeting software 31A. Variation between compression images and the baseline image are compared to variation limits to provide confirmation of proper operation and orientation if appropriate, or to generate an alarm, change the depth of compression or terminate compressions if the variation exceeds the pre-selected limit.

Targeting systems 20 and 31 are discussed above with reference to orientation or targeting software 21 and targeting software 31A respectively. The instructions for controllers such as controllers 15 and 38 may also provided in any suitable hardware or firmware media.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A chest compression device with optical alignment to compress a subject having a midline comprising:

a mounting structure having two legs and a backplate;

a chest compression unit including a reversible electromotor, a plunger having a distal end and a proximal end, the proximal end of the plunger operably coupled to the reversible electromotor, the distal end of the plunger extending from and withdrawing into the compression unit, the chest compression unit secured to the mounting structure to engage the subject along the midline and perform chest compressions;

a controller to control the electromotor and the plunger;

a compression component with a distal end and a proximal end, the proximal end engaging the plunger and the distal end for applying compression force to a subject at a preselected force application location;

software operably connected to the controller to provide instructions to the controller to process data regarding a distance between the compression component and the preselected force application location;

one or more optical sensors operable to provide data to the controller regarding the distance between the compression component and the preselected force application location; and wherein the controller is configured to generate a warning when the compression component contacts the subject outside a preselected lateral distance from the preselected force application location.

2. The device of claim 1 further comprising:

a compression pad removably secured to the subject, the compression pad having a target with a target center point, the target center point aligned with the preselected force application location.

3. The device of claim 2 wherein the target further comprises:

indicia indicating a direction from the indicia to the target center point.

4. The device of claim 2 wherein the compression pad further comprises:

one or more target scales oriented relative to the preselected force application location.

5. The device of claim 4 wherein the one or more target scales indicate the direction from the target scales to the target center point.

6. The device of claim 2 wherein the compression pad further comprises:

a midline scale oriented parallel to the midline;

a lateral scale oriented perpendicular to the midline scale; and wherein the midline scale intersects the lateral scale at the target center point corresponding to the preselected force application location.

7. The device of claim 6 wherein the midline scale is different than the lateral scale.

8. The device of claim 1 wherein the controller is configured to change the depth of compression when the compression component contacts the subject outside a preselected operation limit.

9. The device of claim 1 wherein the controller is configured to stop chest compressions when the compression component contacts the subject outside a predetermined distance from the preselected force application location.

10. The device of claim 1 wherein the preselected warning limit is determined relative to a landmark on the subject's chest.

11. The device of claim 1 wherein the preselected warning limit is determined relative to a target scale.

12. The device of claim 1 wherein a preselected operation limit is determined relative to a landmark on the subject's chest.

13. The device of claim 12 wherein the preselected operation limit is determined relative to a target scale.

14. The device of claim 1 wherein a preselected absolute limit is determined relative to a landmark on the subject's chest.

15. The device of claim 14 wherein the preselected absolute limit is determined relative to a target scale.

* * * * *